United States Patent [19]

Howard et al.

[11] 4,056,644

[45] Nov. 1, 1977

[54] METHOD OF COATING ANNULAR SURFACES

[76] Inventors: Alfred S. Howard; William Selesnick, both of P.O. Box 22226, Cleveland, Ohio 44122

[21] Appl. No.: 621,006

[22] Filed: Oct. 9, 1975

[51] Int. Cl.[2] ..... B05B 13/04

[52] U.S. Cl. ..... 427/284; 118/72; 118/321; 427/299; 427/425

[58] Field of Search ..... 427/284–286, 427/78, 110, 168, 233, 236, 421–427; 118/6, 321, 322; 134/80; 51/15, 15 H

[56] References Cited

U.S. PATENT DOCUMENTS

| | | | |
|---|---|---|---|
| 2,419,951 | 5/1947 | Kastel | 118/321 X |
| 3,190,258 | 6/1965 | Heffley et al. | 118/321 X |
| 3,575,131 | 4/1971 | Lohmann | 118/321 X |

FOREIGN PATENT DOCUMENTS

| | | | |
|---|---|---|---|
| 836,231 | 6/1960 | United Kingdom | 118/321 |

*Primary Examiner*—Morris Kaplan

*Attorney, Agent, or Firm*—Bosworth, Sessions & McCoy

[57] ABSTRACT

A machine and method are disclosed which provide an efficient means for coating the annular surfaces on a plurality of workpieces. The workpieces are moved relative to a gun which sprays a coating material. As each workpiece passes within the spray, the gun moves alternately back-and-forth such that the center of the spray follows the curvature of the annular surface. Simultaneously, the workpiece rotates so that the entire surface is coated. The machine is provided with a camming mechanism for moving the gun, one motor for driving the camming mechanism, another motor for rotating the workpieces, and a series of belt and chain drives for synchronizing the motion of the gun with the movement of the workpieces.

15 Claims, 11 Drawing Figures

Fig. 1
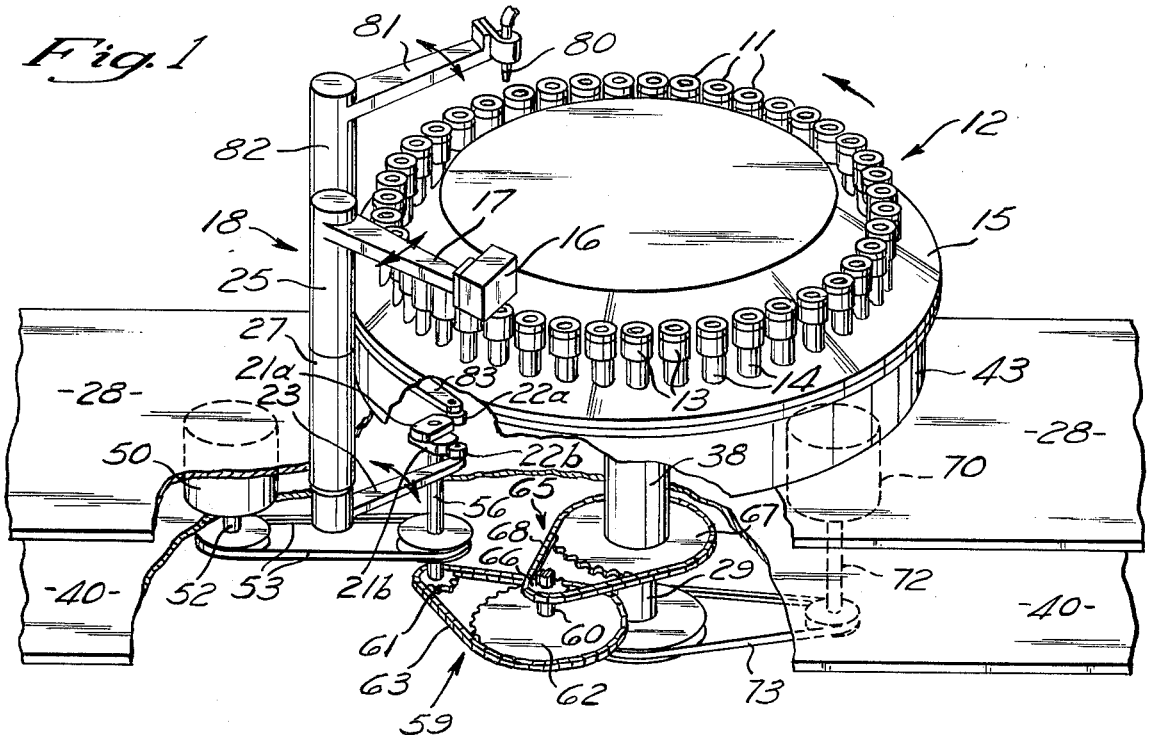
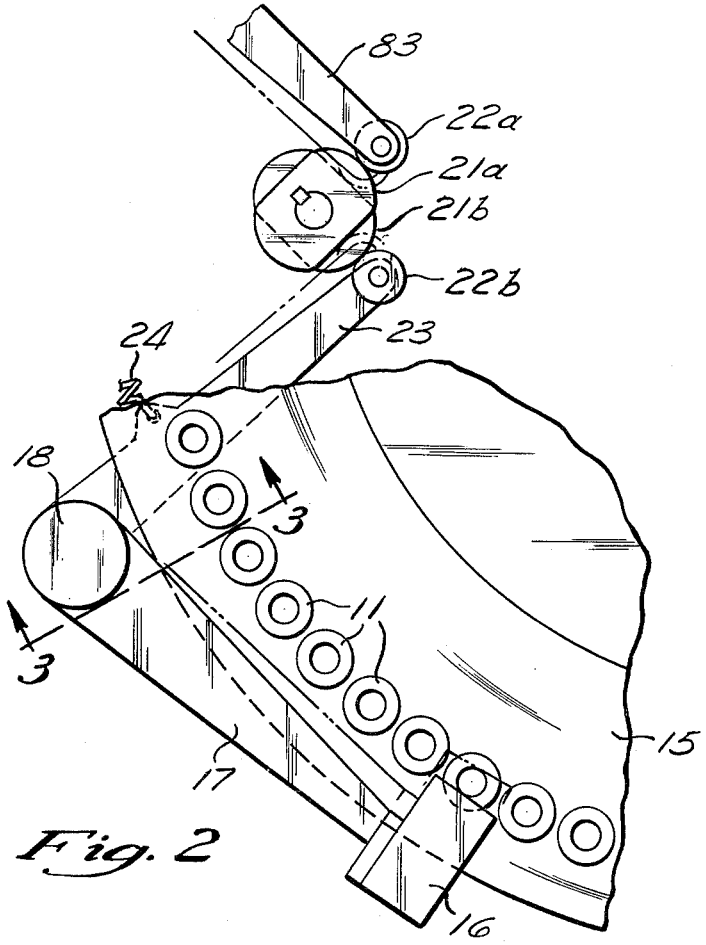
Fig. 2
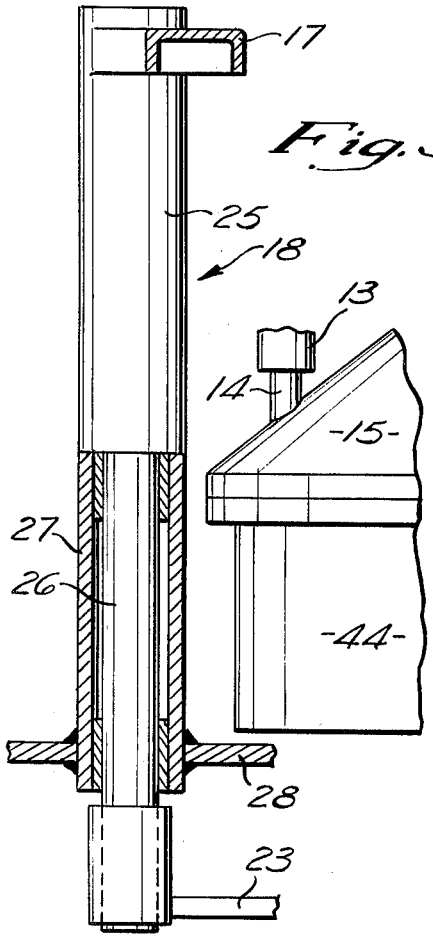
Fig. 3

METHOD OF COATING ANNULAR SURFACES

BACKGROUND OF THE INVENTION

1. Field of the Invention

This invention relates to the spray coating of annular workpieces.

2. Description of the Prior Art

In water pumps for automobiles, for example, and other machinery, small bushing-like parts comprising seals having a smooth and wear-resistant, annular sealing surface are used. Seals of ceramic material having smooth lapped faces have been used in the past for this duty. A sealing surface may also be provided by a hard coating applied to the metallic body of the seal.

When a coating is used to develop the sealing surface, it is important that the coating be applied with as smooth and uniform a surface as possible so that the dressing time and material removed in dressing is minimized.

In an attempt to accomplish this uniformity, coating material has been sprayed onto the surface to be coated. In the past, coating material has been applied by arranging a plurality of the pieces in close proximity to each other on a work surface with their annular faces to be coated facing away from the work surface, and by directing the spray gun at the work surface and moving the gun so that the centerline of the spray describes a series of parallel lines. By this method, only a fairly uniform and smooth coating of material is applied to the annular surfaces of the pieces. Since the spray patterns generally lay a path of material having feathered sides or edges, the spacing of the parallel passes is critical to the achievement of a coating thickness of overall uniformity. Consequently, more material than necessary is often applied and then removed during dressing of the surface in time-consuming, wasteful, and inefficient operations.

Also, because the pattern of the spray covers much more area than the annular surfaces to be coated, e.g., the entire work surface upon which the pieces are arranged, a great deal of coating material is sprayed between the annular surfaces and in the holes of the pieces contributing to further significant waste. In addition, since it takes several passes of the gun to coat each piece, this spraying method is slow and inefficient.

SUMMARY OF THE INVENTION

The method of the present invention sharply reduce the waste of coating material which has resulted from previous spraying methods. Using the present invention, coating material is sprayed onto the annular surface only, not between the surfaces and not in the hole of the annular workpiece. As a result, the spraying of unnecessary areas is avoided and dramatic savings in coating material are obtained.

The present invention also provides a more efficient method of coating annular surfaces both in terms of time of application and of time removal and amount of material required to be removed in order to achieve the desired finished surface. By the method of this invention, the entire annular surface can be sprayed in a single pass beneath the spray gun. Thus a series of annular workpieces can be sprayed rapidly.

These advantages and others are accomplished by the method of the present invention, in which relative translational motion is produced between a plurality of workpieces having annular surfaces facing in a direction generally normal to the motion and a source of spray material such as a plasma spray gun directed at and spaced from them a relatively fixed distance. Preferably, the workpieces are passed successively beneath the spray gun as it simultaneously reciprocates toward and away from the path of travel of the workpieces. As each workpiece passes beneath the spray, the gun goes through one oscillation. The movement of the workpiece and the oscillation of the gun are synchronized so that the gun follows the curvature of the annular surface passing it. At the same time, the workpiece is rotated, bringing the entire annular surface within the field of the spray device to provide the surface with a smooth uniform layer of the coating material.

Alternatively, the method comprehends having the gun translated relative to a stationary array of workpieces. In both the case of a stationary gun and translated workpieces and the case of a translated gun and a stationary array of workpieces, the gun may either be oscillated toward and away from the path of relative translational motion or the workpieces may be moved in an oscillating motion or wavelike path toward and away from the path of relative translational motion.

A particular case comprehended by the method comprises arraying the annular workpiece faces to be coated in a staggered row, i.e., with their centers lying on an alternating wave path. When such an array is translated relative to a gun following a non-oscillating path the advantages and benefits of the method are also realized.

In all of the alternate forms of the method described above, the annular workpieces are rotated about their centers at least during the coating operation.

The preferred embodiment of the current invention uses a turntable to carry the workpieces past a spray gun and a camming mechanism to provide the reciprocating motion to the gun. A series of belt and chain drives synchronize the motion of the cam with the passage of the workpieces by the gun. One motor drives the cam and the turntable assembly. Another motor provides the rotating movement of the workpieces by means of an eccentric drive mechanism.

BRIEF DESCRIPTION OF THE DRAWINGS

FIG. 1 is a perspective view of the apparatus for practicing the method of the present invention;

FIG. 2 is a top plan view partially cut away showing the cam-operated drive for the spray gun movement;

FIG. 3 is a cross sectional view of the pivot shaft taken along line 3—3 of FIG. 2;

DESCRIPTION OF THE PREFERRED EMBODIMENTS

Figure 4:
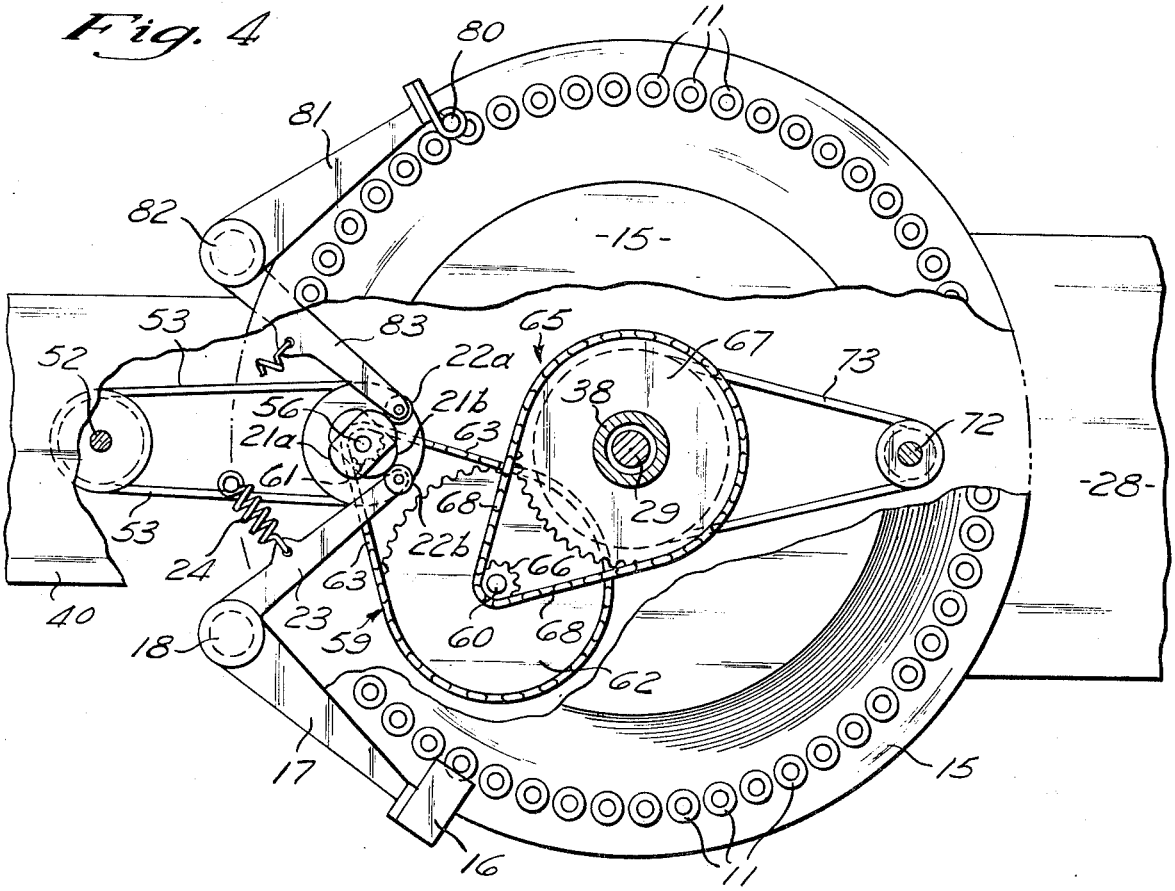
FIG. 4 is a top plan view of the apparatus with sections thereof partially broken away.
Figure 5:
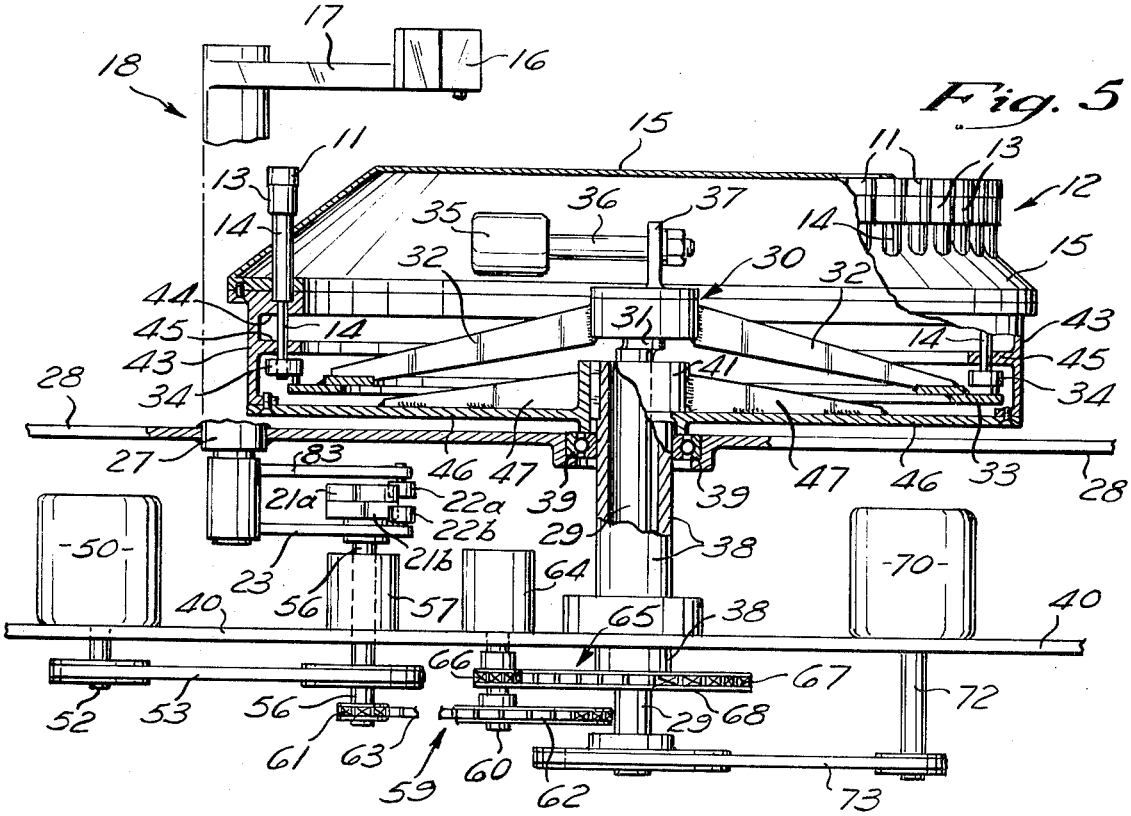
FIG. 5 is a partially sectioned side elevational view of the apparatus.

Referring more particularly to the drawings and initially to FIGS. 1, 4 and 5, there is shown the apparatus which embodies the present invention and which practices the method of the present invention. A plurality of workpieces 11 are arranged in a circular fashion on a turntable assembly 12. Each workpiece 11 has a smooth annular surface which has been prepared to receive a coating of sprayed material. The workpieces are removably mounted on top of workpiece holders 13 with their annular surfaces facing upward. Each holder 13 is axially mounted on top a spindle 14 which projects upwardly through dusthood 15 of turntable assembly 12. Each workpiece 11 is turned about its central axis by rotation of its supporting spindle 14. While each workpiece 11 is rotated, turntable assembly 12 carries the workpieces in a circular path about the assembly axis.

The upwardly facing annular surfaces of workpieces 11 are spray-coated with material from spray gun 16. Gun 16 is supplied by a source of coating material by means of a hose or pipe, not shown. Spray gun 16 is mounted above the line of workpieces 11 and sprays downward onto the annular surfaces. As turntable assembly 12 revolves, workpieces 11 pass, one by one, beneath the spray gun and receive a coating of sprayed material.

Spray gun 16 is mounted on horizontally extending arm 17 which swings about shaft 18. Shaft 18 is turned back-and-forth through a limited angle by means described below. This movement swings arm 17 and moves spray gun 16 toward and away from the path of travel of the workpieces. The oscillation or reciprocation of gun 16 and arm 17 is shown in FIG. 2 with the solid lines depicting one extreme position of the gun and the arm, and the broken lines depicting the other extreme position. The gun oscillates in a direction generally perpendicular to the path of travel of the workpieces. Gun 16 makes one back-and-forth motion for each workpiece 11 passing beneath it. Thus, as turntable assembly 12 revolves, a workpiece 11 passes beneath the gun 16; the gun reciprocates back-and-forth spraying the annular workpiece surface while the workpiece itself rotates. In this manner, the apparatus practices the method of the present invention.

The oscillating motion of the spray gun referred to above is provided by a camming mechanism. Cam 21*b* located beneath turntable assembly 12 is a two-lobe cam and makes one complete rotation for every two workpieces passing beneath the spray gun. Cam follower 22*b* on the end of cam lever 23 tracks the surface of cam 21*b* and is urged against the cam surface by biasing means such as springs 24. As cam follower 22*b* follows cam 21*b*, it swings cam lever 23 attached to and extending from shaft 18 back-and-forth about the shaft axis driving the shaft with an oscillating angular motion. This motion is shown by the solid and broken lines in FIG. 2, with the solid lines depicting the one extreme position of the cam follower and lever, and the broken lines depicting the other extreme position.

As shown in FIG. 3, shaft 18 comprises upper portion 25 and lower portion 26, the former being of larger diameter than the latter. Fixed sleeve 27, supported by upper frame 28, telescopingly receives lower portion 26 and supports the entire shaft 18 for rotation.

As shown particularly in FIG. 5, workpiece holders 13 are rotated by means of an eccentric drive mechanism located within turntable assembly 12. This mechanism is powered by vertically standing crankshaft 29. Drive wheel 30 is mounted on stub shaft 31 of crankshaft 29 offset from the axis of the crankshaft. Drive wheel 30 comprises a number of radial arms 32 extending from its center and supporting at their outer ends an annular ring 33. Ring 33 has a driving connection with the offset shafts of each of a plurality of crankshafts 34 attached to and extending downwardly from work spindle 14.

As crankshaft 29 turns, it imparts an eccentric motion to wheel 30 which causes small crankshafts 34 attached to the bottom of each workpiece spindle 14 to rotate. Turning workpiece spindles 14 rotate workpiece holders 13 and workpieces 11. Through this drive mechanism, each workpiece 11 in circular arrangement on the periphery of turntable assembly 12 is rotated at the same speed as central crankshaft 29.

To balance the off-center moment of the eccentric drive mechanism, counterweight 35 is provided. Arm 36 and support 37 provide means for attachment of counterweight 35 to stub shaft 31 of crankshaft 29. The eccentric drive mechanism provides a simple means for rotating the plurality of workpieces without the necessity of a complex assembly of gears, for example.

The entire turntable assembly 12, including the eccentric drive mechanism, revolves counterclockwise as seen in FIGS. 1 and 4 to pass workpieces 11 beneath spray gun 16. Turntable assembly 12 is driven by a hollow cylindrical main spindle 38 supported for rotation by bearings 39 in upper frame 28 and lower frame 40. The hollow interior accommodates crankshaft 29. Spindle 38 is attached to turntable assembly 12 by means of sleeve 41 located centrally of a drum consisting of circular base plate 46, short cylindrical wall 43 and upper dusthood 15. As spindle 38 turns, the entire drum turns in the manner of a turntable.

Workpiece spindles 14 are spaced along and supported for rotation in a pair of radial flanges 44 and 45 axially spaced apart inside cylindrical wall 43 of the drum. Dusthood 15, which closes the top of turntable assembly 12, has a plurality of holes around its sloped surface from which emerge workpiece spindles 14. Dusthood 15, attached to flange 44 by screws, for example, also serves to protect the eccentric drive mechanism from dirt and overspray, if any, produced by spray gun 16.

Cam 21*b*, main spindle 38, and crankshaft 29 are driven at the proper speeds by means of two motors and a series of belt and chain drives shown in FIGS. 1, 4 and 5. First motor 50, mounted on lower frame 40, provides the drive means for the cam-driven motion of spray gun 16 and for the turntable assembly 12. Shaft 52 extends from first motor 50 and has mounted upon it belt drive 53. Belt drive 53 turns shaft 56 supported for rotation in sleeve 57 mounted on lower frame 40. Shaft 56 supports and turns cam 21.

Chain drive 59, connects shaft 56 with shaft 60 and comprises chain drive wheels 61 and 62 and chain 63. Small chain drive wheel 61 on shaft 56 drives chain 63 which turns large chain drive wheel 62 on shaft 60. Shaft 60 is supported for rotation in sleeve 64 mounted on lower frame 40. Another chain drive 65, comprising wheels 66 and 67 and chain 68, connects shaft 60 with main spindle 38. Small chain drive wheel 66 on shaft 60 drives chain 68 which turns large chain drive wheel 67 attached to main spindle 38.

The double chain drives 59 and 65 with the use of small to large wheels described above gear down the speed of turntable assembly 12 far below the speed of cam 21*b*. Through this speed differential connection, the motions of the oscillating gun 16 and the revolving turntable assembly 12 are synchronized so that the turntable assembly turns at a speed which carries one workpiece 11 beneath the spray gun for each one-half revolution of cam 21*b*.

Second motor 70, also mounted on lower frame 40, provides the drive means for rotating workpieces 11. Shaft 72 which extends from second motor 70 has belt drive 73 connecting it to crankshaft 29. Crankshaft 29 extends through the hollow interior of main spindle 38 to the eccentric drive mechanism located within turntable assembly 12. Second motor 70 has the power and speed to rotate the plurality of workpieces 11 at a fairly high speed so that each workpiece goes through at least several revolutions while it passes beneath the spray gun.

In addition to spray gun 16 already described, the apparatus of the present invention may be provided with sandblasting gun 80 shown in FIG. 1. Sandblasting gun 80 goes through the same oscillating motion as spray gun 16. Gun 80 sandblasts workpieces 11, making the annular surfaces rough so that the spray from gun 16 adheres to the surface. Sandblasting gun 80 is mounted similarly to spray gun 16 on the opposite side of cam 21*a*. Gun 80 is attached to second arm 81 which is mounted on second pivot shaft 82. Cam lever 83 is connected at the bottom of shaft 82. Second cam follower 22*a* is mounted on the end of cam lever 83. Cam follower 22*a* follows along the contour of cam 21*a* like cam follower 22*b* and oscillates cam lever 83 which oscillates arm 81 and provides the same oscillating motion to sandblasting gun 80 as provided gun 16.

The apparatus of the present invention described above in its preferred embodiment can be used to practice the method of the present invention. This method comprises providing translational relative motion between a series of annular workpieces and spray of coating material such as that provided by a spray gun. Preferably, the workpieces are passed individually beneath the spray of the spray gun. The spray gun reciprocates back-and-forth to follow the curvature of the annular surfaces as the workpiece pass beneath it. At the same time, the workpieces rotate. Using this method, very little sprayed material is wasted and each annular surface receives an even coating of sprayed material.

Figure 7:
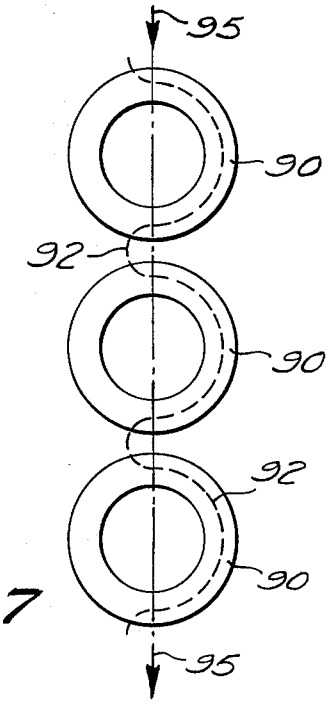
FIG. 7 is a schematic drawing showing the centerline of a spray path over a series of workpieces arranged in a straight line.
Figure 6:
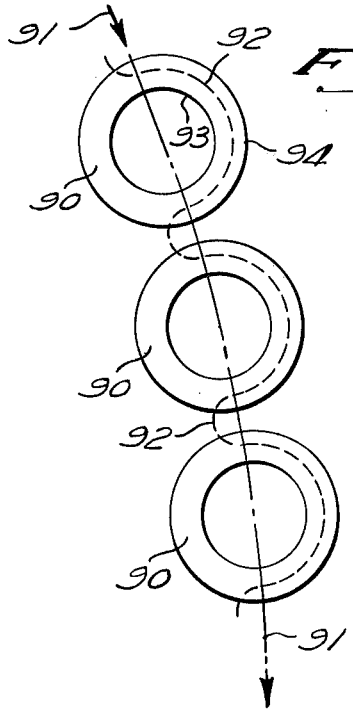
FIG. 6 is a schematic drawing showing the centerline of a spray path over a series of workpieces arranged in a circular fashion.
Figure 8:
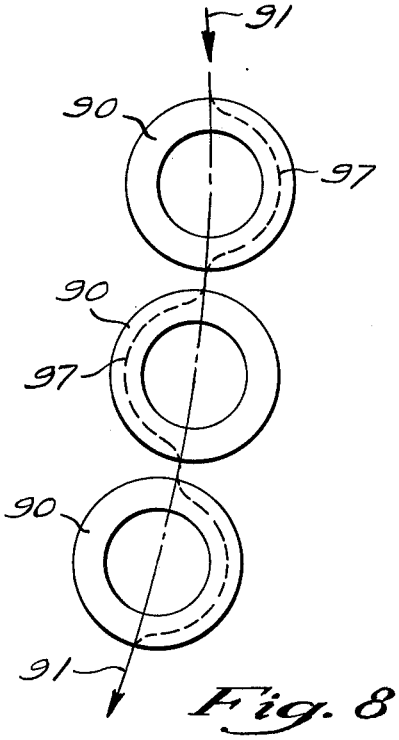
FIG. 8 is a schematic drawing showing the centerline of an alternative spray path over a series of workpieces arranged in a circular manner.

Several embodiments of the method of the present invention are illustrated in schematic form in FIGS. 6 through 8. In FIG. 6, the method depicted is similar to that practiced by the apparatus of the present invention. A plurality of workpieces with annular surfaces 90 travel along a generally arcuate line of direction 91. As the surfaces pass beneath the spray, centerline 92 of the spray path reciprocates back-and-forth between a position just to the left of line of direction 91 and a position approximately midway over the right half of annular surface 90. The speed of the reciprocation is synchronized with the speed of the passing surfaces so that the centerline follows the curvature of the annular surface as each surface passes beneath the spray. Preferably, centerline 92 bisects equal areas on annular surface 90, that is, the area of the surface between centerline 92 and inner edge 93 of annular surface 90 is the same as the area between centerline 92 and outer edge 94 of the surface. Following this path assures that layer of sprayed coating will be uniform across the cross section of the workpiece. If the spray centerline followed a path along the middle of the surface, that is, a line of equal distance between inner edge 93 and outer edge 94, the result would be too much coating toward the inside of the surface and too little coating toward the outside.

While the centerline of the spray is reciprocating back-and-forth, each of the annular surface is rotating. Through this rotation, the entire annular surface obtains an even coating of the sprayed material. The annular surface must be rotated at least once while it is passing beneath the spray. Preferably, the annular surface rotates about ten times while it is being sprayed.

Other embodiments of the present method are depicted in FIGS. 7 through 11. FIG. 7 shows a method similar to FIG. 6 with annular surfaces 90 and a reciprocating centerline of spray 92. However, in this embodiment the annular surfaces travel in a straight line of direction 95 instead of an arcuate line. This method can be employed to spray a plurality of annular surfaces emerging on a straight assembly line.

FIG. 8 shows an embodiment of the present method in which annular surfaces 90 travel in an arcuate line of direction 91, but in which centerline of the spray 97 reciprocates over both halves of annular surfaces 90. In this embodiment, the spray is directed on the right side of line of direction 91 for one piece and on the left side of the line of direction of the following piece. Spray centerline 97 reciprocates at about half the speed as the centerline of the previous two embodiments so that two pieces are sprayed for each full reciprocation. As with the other embodiments, the motion and the timing of spray centerline 97 is directed and synchronized such that it follows the arc of each annular surface 90. The spray centerline bisects equal areas on each annular surface as in FIGS. 6 and 7.

Figure 9:
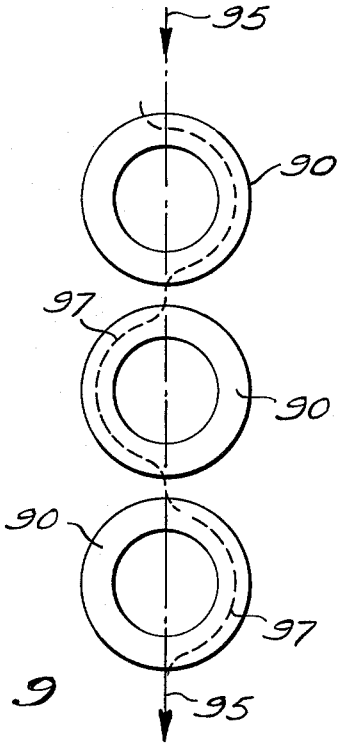
FIG. 9 is a schematic drawing showing the centerline of an alternative spray path over a series of workpieces arranged in a straight line.

FIG. 9 shows another embodiment of the present method in which the annular pieces travel in a straight line of direction 95 and the centerline of spray 97 covers both halves of the workpieces as with the FIG. 8 embodiment.

Figure 11:
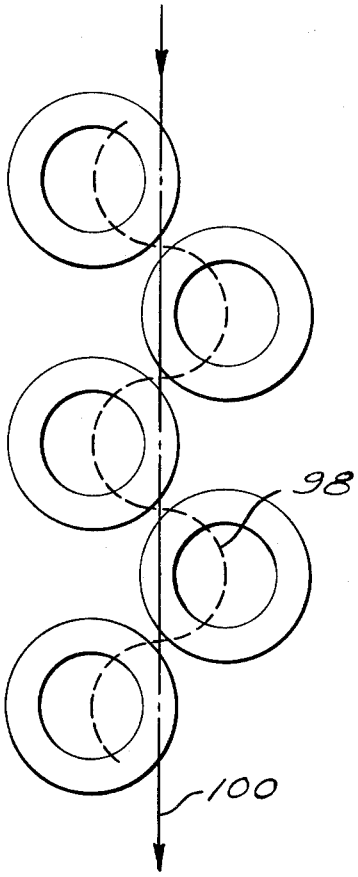
FIG. 11 is a schematic drawing showing the workpieces arranged in a straight row along a generally straight path.
Figure 10:
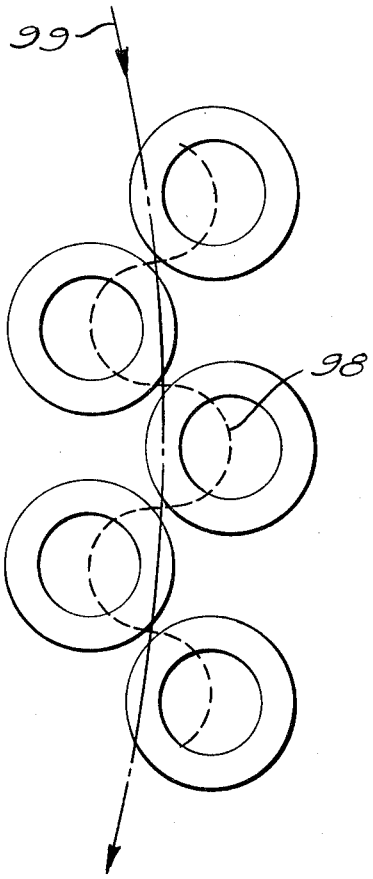
FIG. 10 is a schematic drawing showing the workpieces arranged in a staggered fashion along a generally arcuate path.

FIGS. 10 and 11 show other embodiments of the present method in which the annular pieces are arrayed in a staggered fashion so that the centers of adjacent ones of the workpieces lie on opposite cycles along a wave-like path 98. Relative translational motion along a path between what is effectively an oscillating array and a non-oscillating gun provides all the advantages and benefits of the invention as described above in connection with other forms of the method. In FIG. 10, the staggered array generally follows an arcuate path 99 and in FIG. 11, a straight path 100.

All of the embodiments just described may be employed to provide an even spray over the entire annular surface. Depending upon the application of this method, it may be more advantageous to have the surfaces travel in a straight line as in FIGS. 7, 9 and 11 or in an arcuate line as in FIGS. 6, 8 and 10. Similarly, it may be more advantageous to have the spray centerline reciprocate at a slower speed and spray across both sides of the line of direction, as in FIGS. 8 and 9, or to have the spray centerline follow a simpler pattern and spray mainly on one side of the line of direction while reciprocating at the higher speed, as in FIGS. 6 and 7.

In each of the embodiments just described, the workpieces are passed beneath the spray of the gun. However, the method of the present invention can also be practiced by moving the gun along a stationary line of workpieces and simultaneously reciprocating the gun or the workpieces. The important step in the method is producing the requisite relative motions between the workpieces and the spray gun, and it is not critical whether the workpieces or the gun or both are moved to produce these relative motions. In all cases, of course, the annular workpieces are rotated about their centers.

It will also be understood that the drive mechanisms for the various motions involved in the apparatus disclosed herein may be provided by other known means; e.g., gear trains instead of belt and pulley drives.

While the invention has been shown and described with respect to its specific embodiments, this is intended for the purpose of illustration rather than limitation, and other variations and modifications of the specific forms of the invention shown and described will be apparent to those skilled in the art all within the intended spirit and scope of the invention. Accordingly, the patent is not to be limited to the specific embodiment shown and described nor in any other way that is inconsistent with the extent to which the progress in the art has been advanced by the invention.

We claim:

1. A method of coating annular surfaces on a plurality of workpieces each having an annular surface, which comprises:

a. producing a relative translational component of motion between an array of workpieces and a spray of a coating material by which each workpiece passes individually within the spray with the annular surface to be sprayed facing the point of origin of the spray;

b. simultaneously relatively moving the point of the spray and the workpieces back-and-forth in a plane generally parallel to the plane of motion of step (a) and in synchronization with the motion of step (a) so that the path of the spray follows a portion of the curvature of each of the annular surfaces as the surface passes within the spray;

c. rotating the workpieces through at least one revolution while each workpiece is within the spray; and d. spraying each workpiece with the coating material.

2. The method of claim 1 in which the centerline of the path of the spray bisects each annular surface into equal annular surface areas.

3. The method of claim 1 in which the path of the spray follows the same corresponding curvature for each and every workpiece.

4. The method of claim 1 in which the path of the spray alternates between different halves of the annular surface for each workpiece so that the path follows the same curvature for every second workpiece.

5. The method of claim 1 in which steps (a) and (b) comprise arranging the workpieces in a staggered fashion with the centers of the annular surfaces of adjacent ones of the workpieces lying on opposite cycles along a wave-like path and the point of the spray is non-oscillating.

6. The method of claim 1 in which steps (a) and (b) comprise arranging the workpieces in a row with the centers of their annular surfaces lying along a generally straight path.

7. The method of claim 1 in which steps (a) and (b) comprise arranging the workpieces in a row with the centers of their annular surfaces lying along a generally arcuate path.

8. A method of coating annular surfaces on a plurality of workpieces each having an annular surface, which comprises:

a. passing the workpieces individually beneath a spray of coating material with the annular surfaces to be sprayed facing the point of origin of the spray;

b. simultaneously moving the point of the spray back-and-forth in a direction substantially perpendicular to the direction in which the workpieces are passed, the back-and-forth movement synchronized with the movement of the workpieces so that the centerline of the spray follows the curvature of the annular surface and bisects each annular surface into equal annular surface areas;

c. rotating the workpieces through at least one revolution while each workpiece is beneath the spray; and d. spraying each workpiece with the coating material.

9. A method of coating annular surfaces on a plurality of workpieces each having an annular surface, which comprises:

a. moving an array of workpieces relative to a spray of a coating material by which each workpiece passes individually within the spray with the annular surface to be sprayed facing the point of origin of the spray;

b. simultaneously moving the point of the spray back-and-forth relative to the workpieces in a plane generally parallel to the plane of motion of step (a) and in synchronization with the motion of step (a) so that the path of the spray follows a portion of the curvature of each of the annular surfaces as that surface passes within the spray;

c. rotating the workpieces through at least one revolution while each workpiece is within the spray; and d. spraying each workpiece with the coating material.

10. The method of claim 9 in which the centerline of the path of the spray bisects each annular surface into equal annular surface areas.

11. The method of claim 9 in which the path of the spray follows the same corresponding curvature for each and every workpiece.

12. The method of claim 9 in which the path of the spray alternates between different halves of the annular surface for each workpiece so that the path follows the same curvature for every second workpiece.

13. The method of claim 9 which the point of the spray moves back-and-forth in a direction substantially perpendicular to the direction of the motion of the workpieces.

14. The method of claim 10 in which the workpieces are moved relative to the spray by orbitally revolving the plurality of workpieces.

15. The method of claim 10 in which the workpieces are moved relative to the spray by passing the workpieces beneath the spray in a generally straight line of direction.

* * * * *